US012331981B2

(12) United States Patent
Metzger

(10) Patent No.: US 12,331,981 B2
(45) Date of Patent: Jun. 17, 2025

(54) ICE VENDING MACHINE HAVING REDUCED FOOTPRINT

(71) Applicant: Quick and Pure Holdings, LLC, Milwaukee, WI (US)

(72) Inventor: Mark Metzger, Phoenix, AZ (US)

( * ) Notice: Subject to any disclaimer, the term of this patent is extended or adjusted under 35 U.S.C. 154(b) by 210 days.

(21) Appl. No.: 17/854,330

(22) Filed: Jun. 30, 2022

(65) Prior Publication Data

US 2023/0003433 A1 Jan. 5, 2023

Related U.S. Application Data

(60) Provisional application No. 63/217,002, filed on Jun. 30, 2021.

(51) Int. Cl.
*F25C 5/20* (2018.01)
*B65B 1/36* (2006.01)

(52) U.S. Cl.
CPC . *F25C 5/20* (2018.01); *B65B 1/36* (2013.01)

(58) Field of Classification Search
CPC ..... G07F 17/0071; F25C 5/20; B65B 5/022; B65B 43/26; B65B 1/36; B65B 51/146; B65B 29/002–39/003
See application file for complete search history.

(56) References Cited

U.S. PATENT DOCUMENTS 3,211,338 A * 10/1965 Weil ..... F25C 5/20 222/413
4,368,608 A 1/1983 Ray
4,942,983 A 7/1990 Bradbury
5,109,651 A 5/1992 Stuart
5,440,863 A 8/1995 Toya et al.
5,458,851 A 10/1995 Schroeder
5,581,982 A 12/1996 Schroeder et al.
5,630,310 A 5/1997 Chadwell
5,822,955 A 10/1998 Woosley et al.
D407,092 S 3/1999 Weaver
(Continued)

FOREIGN PATENT DOCUMENTS

CA 980305 12/1975
WO 2019236740 12/2019
WO 2019236740 A1 12/2019

OTHER PUBLICATIONS https://www.dictionary.com/browse/cradle. Definition of the term cradle (Year: 2024).*

(Continued)

*Primary Examiner* — Cassey D Bauer
(74) *Attorney, Agent, or Firm* — Boyle Fredrickson, S.C.

(57) ABSTRACT

An ice vending machine is provided that has a minimal footprint, while still being able to quickly and efficiently fill bags of ice. The machine has a cabinet, a frame within the cabinet, and an ice maker mounted to the cabinet and/or the frame. Once the ice maker has made ice, the ice is deposited into a hopper. The ice vending machine may have multiple hoppers through which the ice is guided to a bagging system. Once the ice has been inserted into a bag by the bagging system, the filled bag is sealed. Once the bag has been sealed, it can be delivered to a customer, otherwise it can be stored in a cooler section. The ice vending machine has a number of high power motors that enable fast movement of the ice to generate the bags of ice in minimal time.

16 Claims, 14 Drawing Sheets

(56) References Cited

U.S. PATENT DOCUMENTS

| | | | | |
|---|---|---|---|---|
| 6,112,539 | A | 9/2000 | Colberg | |
| 6,474,048 | B1 | 11/2002 | Metzger et al. | |
| 6,932,124 | B2 | 8/2005 | Dalton et al. | |
| 7,062,892 | B2 | 6/2006 | Metzger | |
| 7,207,156 | B2 | 4/2007 | Metzger | |
| 7,426,812 | B2 | 9/2008 | Metzger | |
| 7,497,062 | B2 | 3/2009 | Metzger | |
| 7,681,408 | B2 | 3/2010 | Hobson et al. | |
| 7,757,513 | B2 | 7/2010 | Paine | |
| 7,810,301 | B2 | 10/2010 | Metzger | |
| 7,849,660 | B2 | 12/2010 | Metzger | |
| 7,900,660 | B2 | 3/2011 | Ladson | |
| 7,958,918 | B2 | 6/2011 | Ladson | |
| 8,091,374 | B2 | 1/2012 | Chang | |
| 8,122,689 | B2 | 2/2012 | Pape | |
| 8,132,392 | B2 | 3/2012 | Metzger | |
| 8,256,195 | B2 | 9/2012 | Pape | |
| 8,381,534 | B2 | 2/2013 | Metzger | |
| 8,468,784 | B2 | 6/2013 | Metzger | |
| 8,484,935 | B2 * | 7/2013 | LeBlanc | B65B 51/146 53/440 |
| 8,511,101 | B1 | 8/2013 | Seymour | |
| 8,528,302 | B1 * | 9/2013 | Shaker | B65B 43/26 62/331 |
| 8,534,034 | B1 | 9/2013 | Pape | |
| 8,739,557 | B2 | 6/2014 | Metzger | |
| 8,763,352 | B2 | 7/2014 | Metzger | |
| 8,800,305 | B2 | 8/2014 | Pape et al. | |
| 8,863,985 | B2 | 10/2014 | Berge et al. | |
| 8,935,906 | B2 | 1/2015 | Pape | |
| 9,134,060 | B2 | 9/2015 | Seymour | |
| 9,409,726 | B2 | 8/2016 | Pape | |
| 9,428,289 | B2 | 8/2016 | Pape | |
| 9,562,711 | B2 | 2/2017 | Pape | |
| 9,643,742 | B2 | 5/2017 | Metzger | |
| 9,688,423 | B2 | 6/2017 | Metzger | |
| 9,696,082 | B2 | 7/2017 | Pape | |
| 10,066,862 | B2 | 9/2018 | Metzger | |
| 10,093,482 | B2 | 10/2018 | Pape | |
| 10,160,557 | B2 | 12/2018 | Metzger | |
| 10,161,664 | B2 | 12/2018 | Tadhani et al. | |
| 10,189,646 | B2 | 1/2019 | Pape | |
| 10,240,844 | B1 | 3/2019 | Metzger et al. | |
| 10,502,474 | B2 | 12/2019 | Metzger | |
| 10,871,319 | B2 | 12/2020 | Witt et al. | |
| 10,894,662 | B2 | 1/2021 | Pape | |
| 2004/0216481 | A1 | 11/2004 | James et al. | |
| 2007/0175235 | A1 * | 8/2007 | Metzger | B65B 61/28 62/344 |
| 2011/0047941 | A1 * | 3/2011 | Metzger | B65B 1/36 53/469 |
| 2014/0137513 | A1 | 5/2014 | Shaker | |
| 2020/0290802 | A1 | 9/2020 | Pape | |

OTHER PUBLICATIONS

PCT International Search Report PCT/US22/35706; dated Sep. 22, 2022; 2 pages.

Partial European Search Report for Application No. 22834213.5 dated Apr. 1, 2025 (13 pages).

* cited by examiner

ICE VENDING MACHINE HAVING REDUCED FOOTPRINT

CROSS-REFERENCE TO RELATED APPLICATION

The present application claims priority on U.S. Provisional Patent Application Ser. No. 63/217,002, filed on Jun. 30, 2021, and entitled Ice Vending Machine with Reduced Footprint, the entirety of which is hereby incorporated herein by reference.

BACKGROUND OF THE INVENTION

The present invention relates in general to the field of ice vending machines. More particularly, the present invention relates to an ice vending machine that has a compact footprint. Additionally, the present invention relates to an ice vending machine that can quickly create bags of ice, allowing for less ice to be stored prior to bagging.

A variety of bulky ice vending machines are known in the art. Historically, ice vending machines consisted of large coolers where bags of ice that were manufactured at a different location are transported and delivered into the cooler. In addition to transportation costs, such a system oftentimes led to breaking of bags during delivery, melting of ice during the delivery process, and other undesired results.

More recently, ice vending machines had various components that allow ice to be manufactured and bagged within the machine, before being deposited into a storage section. These types of ice vending machines required a very large footprint to accommodate the bags of ice, as well as the components required to manufacture the ice, bag the ice, seal the ice in a bag, and deliver the sealed bag to a large storage compartment. Additionally, these machines typically had a large reservoir of ice held in a hopper after manufacture by an ice maker, but prior to bagging. In order to maintain that ice, additional components were oftentimes incorporated into the hopper to break up the ice, prevent it from thawing and refreezing, etc. Also, large storage compartments for bagged ice were filled with substantial quantities of ice that had to be manufactured and stored for extended periods of time to accommodate demand. For instance, these units were routinely larger than six feet in length and four feet in depth. These large storage compartments were necessary to meet demand because systems could only bag ice at relatively slow rates, such as four minutes per bag of ice or longer.

Apart from the large space required for installation and operation of these machines, which was problematic for many convenience and other stores that had limited amounts of space for such devices, the storage of large quantities of ice frequently resulted in stale bags of ice. Additionally, machines with large storage sections filled with bags of ice are often susceptible to theft.

A number of these deficiencies were addressed in U.S. patent application Ser. No. 16/432,531 titled "Ice Vending Machine and Related Methods", which was filed on Jun. 5, 2019, which claimed priority to U.S. Application No. 62/681,328 titled "Ice Vending Machines and Related Methods", which was filed on Jun. 6, 2018, the disclosure of both of which are hereby incorporated by reference. While these applications disclosed ice vending machines that were superior to the prior art described above, further improvements are desired.

For instance, there is a need for an ice vending machine having a significantly reduced footprint. Similarly, there is need for an ice vending machine that is capable of rapidly manufacturing ice and bagging the ice to meet demand. Flexibility in throughput is also desirable. Still further, ease in servicing an ice vending machine and ease in changing rolls of bags are sought after features. Overall, there is a need for an ice vending machine that is an improvement over the prior art.

SUMMARY OF THE INVENTION

In accordance with an aspect of the present invention, an ice vending machine is provided that includes a frame, a cabinet extending around the frame, at least one ice maker coupled to the frame, a first ice hopper, an auger, a second hopper, a bagging assembly, and a retrieval section. The first ice hopper is located beneath the ice maker and is configured to receive ice from the ice maker. The first ice hopper may be a drying hopping having a sloped bottom surface to drain water away from the second hopper. Thereafter, the auger moves ice from the first hopper through an opening into the second hopper. The bagging assembly receives ice from the second hopper, after which a bag of ice is deposited in the retrieval section. The retrieval section may include a refrigerated storage section that is located beneath the bagging assembly.

According to another aspect of the present invention, the cabinet is not more than 34 inches in depth.

According to yet another aspect of the present invention, the auger is rotated by an auger motor having a rotational speed of approximately 1500 rotations per minute, and a gear head that reduces the rotational speed to approximately 115 rotations per minute. Further still, the first hopper is configured to receive and hold between 300-400 pounds of ice.

According to another aspect of the invention, a sealing system is provided that includes a heating element, a pusher plate, and a biasing assembly coupled to the pusher plate. An opening is formed in the pusher plate, where the heating element may be exposed through the opening when the biasing assembly moves the pusher plate in order to seal a bag of ice. Furthermore, a pusher section includes a chute that extends from and is pivotable about the second hopper, as well as a motor that is coupled to the chute. The motor is configured to drive the chute towards the sealing system to facilitate the sealing of the bag of ice using the heating element.

According to another aspect of the invention, the machine includes a roll of bags that are removably mounted to the frame, as well as a motor that is configured to advance a portion of the roll of bags to the bagging system. Further, the machine includes a sensor that scans each bag from the roll of bags. In the event that the sensor identifies an unverified bag design, the advancement of the roll of bags to the bagging system by the motor can be terminated.

According to yet another aspect of the invention, a cradle is provided, where a bag from the bagging assembly is received. The bag may be opened by a blower, after which ice is deposited from the second hopper into the bag contained within the cradle, after which the cradle is rotated to deposit a plurality of bags of ice into the refrigerated storage section.

According to yet another aspect of the present invention, a method of using an ice vending machine is provided. The method includes dropping a plurality of ice from an ice maker into a first hopper, opening a bag using a bag assembly, rotating an auger contained within the first hopper to move ice towards an opening in the first hopper, dropping ice through the opening into a second hopper, dropping the ice through the second hopper into the bag, deactivating the auger, sealing the bag, and moving the bag to a retrieval section. The rotating step may include activating a motor having a rotational speed of approximately 1500 rotations per minute to rotate the auger. The auger may be rotated within the first hopper to move ice upwardly towards the opening in the first hopper between first and second sidewalls, after which the ice is dropped through the opening into a second hopper having a funnel. The ice is then guided towards the bag using a chute.

According to another aspect of the invention, the method also includes heating of a heating element, moving a pusher plate to expose the heating element, contacting the bag with the heating element to seal the bag, and moving the pusher plate to separate the heating element from the bag. Also, the method may include the steps of activating a motor associated with the chute extending from the second hopper, pivoting the chute and a support bag towards the heating element, pivoting the chute and supported bag away from the heating element, and disengaging the bag from a roll of bags.

According to another aspect of the invention, the method includes the steps of advancing the bag from a roll or bags using a roller, scanning a portion of the bag using a sensor, comparing the portion of the bag to a database of acceptable bag images, and deactivating rotation of the roller if the portion of the bag does not match the database of acceptable bag images.

According to yet another aspect of the invention, the method includes opening a bag in a cradle mounted within the retrieval section, filling the bag with ice from the first hopper through the second hopper, sealing the bag of ice, rotating the cradle about the retrieval section, and dropping the bag of ice into a refrigerated storage space.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

DESCRIPTION OF THE DRAWINGS

Exemplary embodiments of the invention are illustrated in the accompanying drawings in which like reference numerals represent like parts throughout, and in which.

DETAILED DESCRIPTION OF THE PREFERRED EMBODIMENTS

Illustrative embodiments of an ice vending machine in accordance with the present invention are shown in the figures. While many of the components associated with the ice vending machine and shown in the figures will be described herein, additional components, including those present in the prior art, could similarly be incorporated into the ice vending machine of the present invention.

Figure 1:
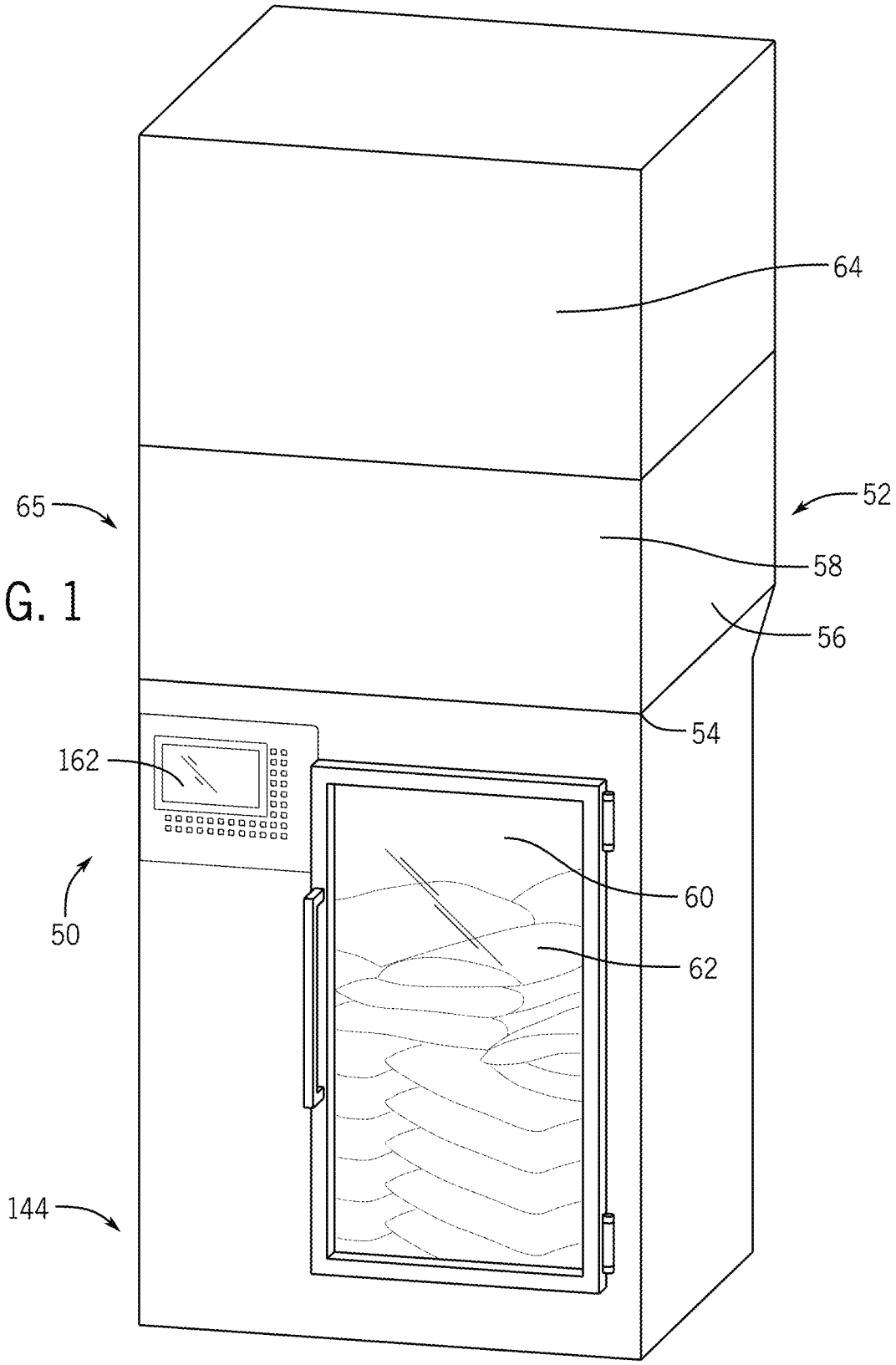
FIG. 1 is an isometric perspective view of an inventive ice vending machine.
Figure 2:
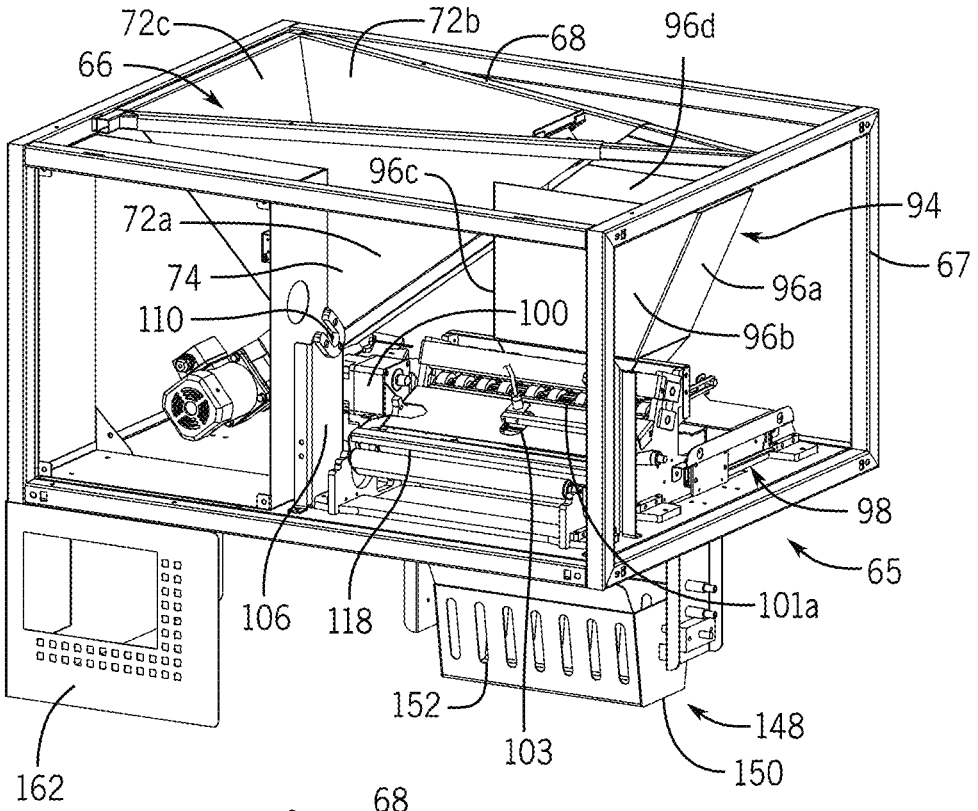
FIG. 2 is a first isometric perspective view of an ice storage and bagging section of the inventive ice vending machine of FIG. 1.
Figure 3:
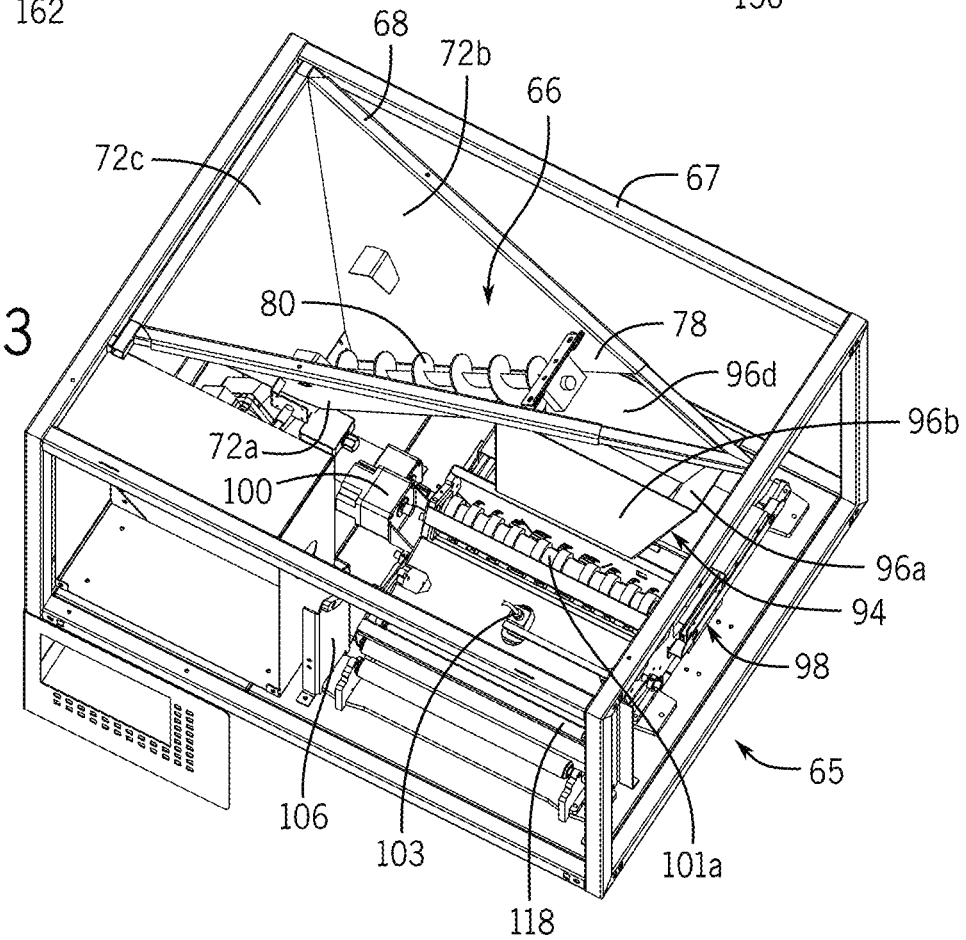
FIG. 3 is a second isometric perspective view of the ice storage and bagging section of the FIG. 2.
Figure 4:
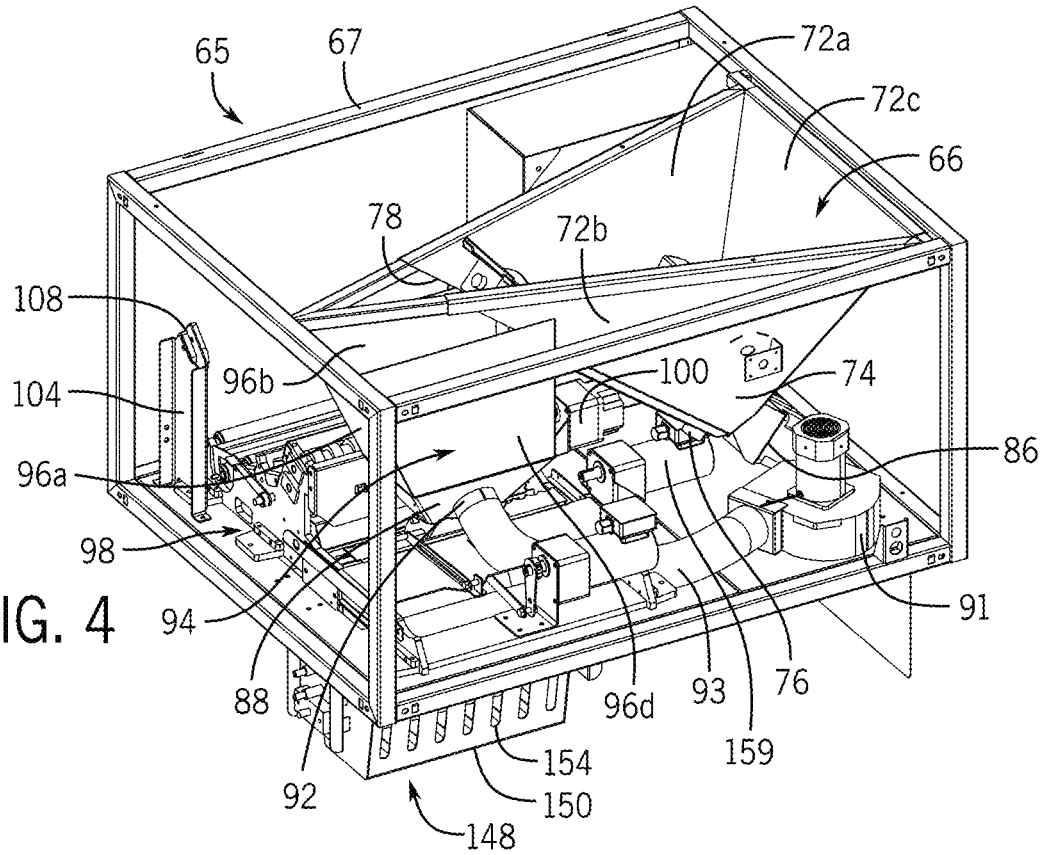
FIG. 4 is a third isometric perspective view of the ice storage and bagging section of the FIGS. 2 and 3.
Figure 5:
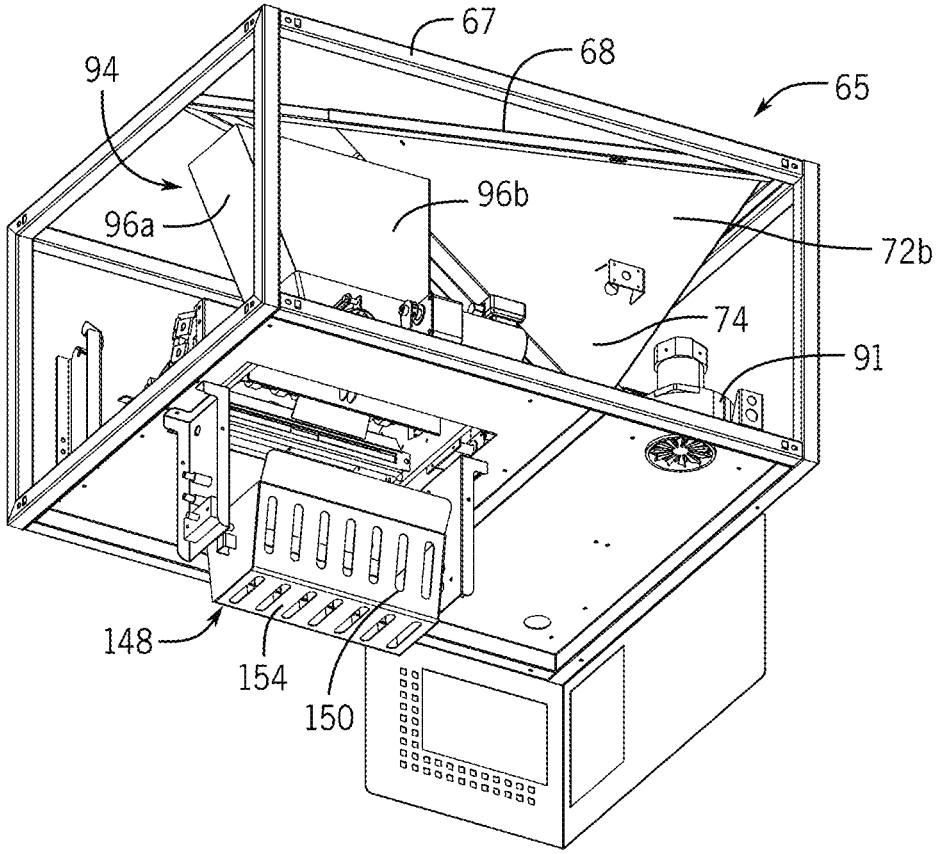
FIG. 5 is a fourth isometric perspective view of the ice storage and bagging section of the FIGS. 2-4.

Turning initially to FIG. 1, the ice vending machine 50 includes a durable cabinet 52 and frame 54 contained within the cabinet 52. The cabinet 52 has four sides 56, including at least one side having a maintenance door or panel 58 that can be opened by an attendant. The maintenance door 58 may take up a full side, although it could also be limited to only a portion of the side. The ice vending machine 50 could have multiple maintenance doors (not shown) for access to different portions of the interior of the ice vending machine 50. Additionally, the cabinet 52 preferably has at least one ice retrieval door 60 that allows a customer to retrieve a bag 62 of ice 51 once it is ready or otherwise available. The ice retrieval door 60 may be locked until a bag 62 of ice is ready or payment is received. Preferably, apart from the ice retrieval door 60, the ice vending machine 50 is sealed such that the interior of the machine 50 cannot be accessed unless the maintenance door or panel 58 is opened. The retrieval door 60 may be made of the same material as the cabinet or as shown in the figures it may be a glass door allowing customers to see inside the machine 50 to ascertain the availability of bags of ice or to see when a bag of ice has completed filling Additionally, the ice vending machine 50 has at least one ice maker 64 mounted to the frame 54. As shown, the ice maker 64 is mounted towards the top of the frame 54, although it could be mounted elsewhere. A variety of different ice makers 64 may be installed depending on the quantity of ice 51 that is needed on a routine basis. By way of example and not limitation, potential ice makers include a KM-1301 SAJ Hoshizaki ice maker, which makes up to 1,300 pounds of ice per 24 hours, Hoshizaki model KM-1601 SAJ, which makes up to 1,600 pounds of ice per 24 hours; Hoshizaki model KM-1900 SAJ, which makes up to 1,900 pounds of ice per 24 hours; Hoshizaki model KM-2200 SRJ3, which makes up to 2,200 pound of ice per 24 hours; or Hoshizaki model KM-2600 SRJ3, which makes up to 2,600 pounds of ice per 24 hours. In terms of selection of the appropriate ice maker, for ice vending machines 50 located at high-demand locations, a higher quality, and thus faster operating ice maker 64 is preferable. This ensures that the ice maker 64 is capable of manufacturing ice 51 quickly enough to fill the bags 62. Additionally, or alternatively, multiple ice makers 64 may be mounted to the frame 54 for high-demand locations. For instance, two KM-2600 ice makers on one system can produce up to 5200 pounds of ice per day, enough to bag 520 ten-pound bags a day despite the relatively small footprint of the ice vending machines described herein.

For locations having less demand, slower throughput ice makers 64 may be used. Additionally, the ice makers 64 need not be permanently mounted to the frame 54 to permit flexibility in replacing the ice maker(s) 64 in the field to meet the demand of a given location. This customizability allows the characteristics of the ice vending machine 50 to be changed based on analytics or other criteria used to determine the demand at a given location.

Still looking to FIG. 1, in one embodiment of the present invention, an ice storage and bagging section 65 is located directly beneath the ice maker 64. The ice storage and bagging section 65 is shown in isolation with the sides removed to expose the interior components in FIGS. 2-15. The ice storage and bagging section 65 includes a frame 67 having various other components described herein mounted thereto. The maintenance door 58 described above is removably secured to the frame 67 to prevent unauthorized access to the interior of the frame 67. In the illustrated embodiment, the ice maker 64 is mounted to the top of the frame 67.

Once the ice 51 is made by the ice maker 64, it is dropped into a first hopper 66 of the ice storage and bagging section 65 that is located beneath the ice maker 64. As shown in FIGS. 2-5, the first hopper 66 has an upper section 68 that is substantially triangular in shape and having three sloped sides 72*a*, 72*b*, 72*c* down to a lower section 74 to form a funnel shape. The sloped sides 72*a*, 72*b*, 72*c* funnel and move the ice 51 downwardly. Additionally, the first hopper has an opening 78 formed therein, with the opening being located towards the upper section 68 between the first side 72*a* and second side 72*b*. The first hopper 66 is oriented to allow water to drain away from the ice 51, such that water is not transferred into a bag when the ice 51 is deposited into the bag 62. More specifically, the sides 72*a*, 72*b*, 72*c* are sloped downwardly away from the opening 78. In this way, the first (drying) hopper 66 can be used to funnel water out of the system. To facilitate this functionality, there is a drain 76 formed in the lower section 74 that allows the water to be drained out of the first hopper 66. The drain 76 is located in the lower section 74 of the first hopper 66 and is routed to a floor drain or sump pump. In this configuration, water is harvested and drained off the ice cubes 51 before they are moved to a second hopper described below.

The first hopper 66 has a capacity of between 35-95 pounds of ice, more preferably between 50-80 pounds of ice, and most preferable approximately 65 pounds of ice. In contrast to ice vending machines of the prior art, the first hopper 66 has a reduced footprint, and is oriented in a particular manner relative to the cabinet 52 so that the cabinet 52 only needs to be 34 inches in depth. This allows the ice vending machine 50 to fit in a standard grocery store aisle, while still having sufficient capacity to manufacture and bag ice at a high speed.

Preferably sensors (not shown) are located within the first hopper 66. In one preferred embodiment, a first sensor is located near the top of the first hopper. When the first sensor is covered by ice, the ice maker is deactivated to avoid excessive manufacture of ice. Once the first sensor is uncovered, the ice maker is reactivated to ensure that sufficient amount of ice is present in the first hopper 66 for ice to be bagged and dispensed and/or stored.

Figure 11:
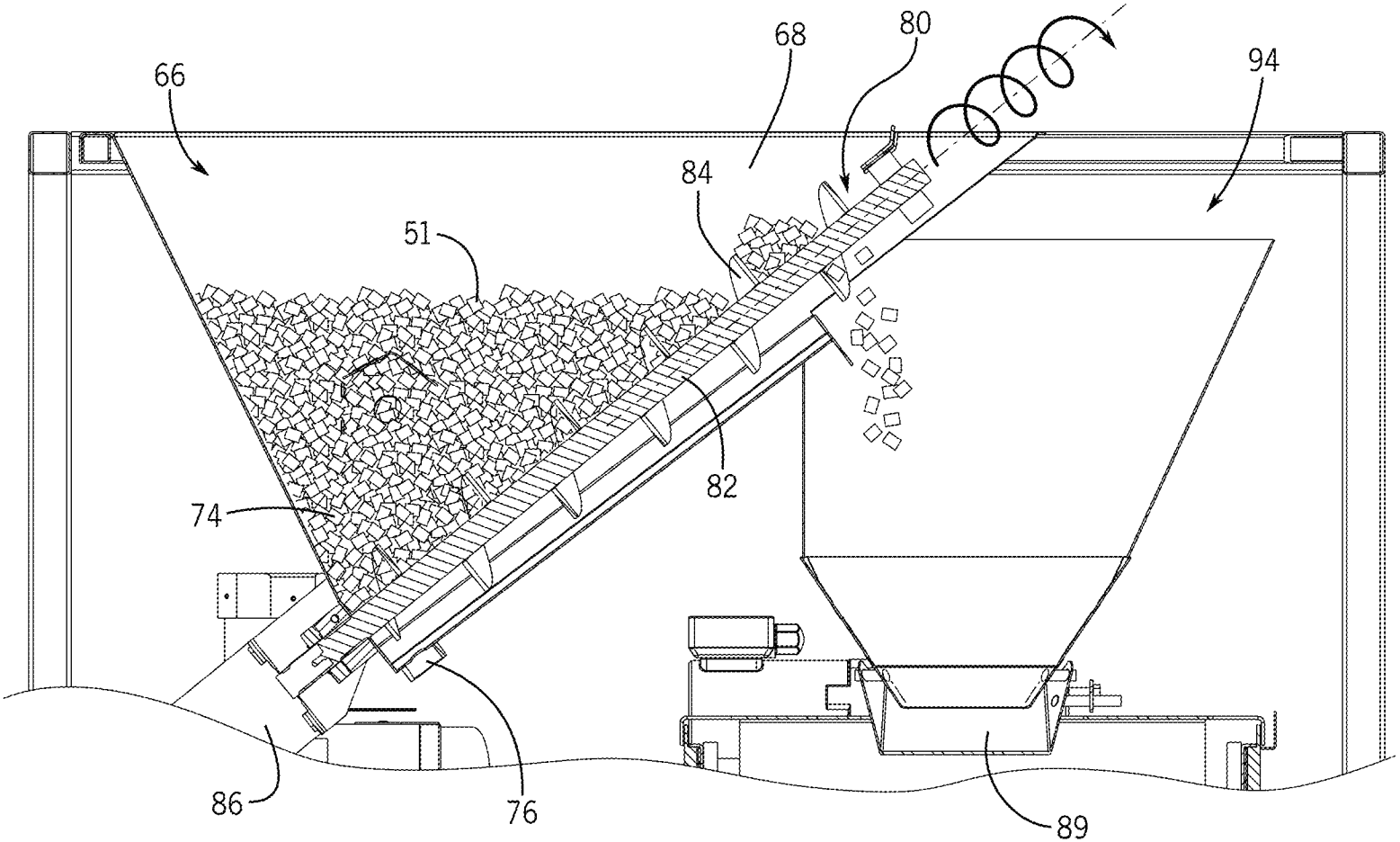
FIG. 11 is a first cutaway side elevation view showing ice being moved through a first hopper into a second hopper of the present machine.

The first hopper 66 includes an auger 80 that moves ice 51 from the lower section 74 to the opening 78 and into a second hopper 94 as best seen in FIG. 11. The auger 80 is positioned to extend along the first and second sidewalls 72*a*, 72*b* from the lower section 74 up to the opening 78 as seen in FIGS. 3, 8, and 11-13. The lower section 74 is inclined away the opening 78 such that water is drained away from the opening 78 as described above. The auger 80 includes a shaft 82 and a corkscrew 84 configured to move ice 51 upwardly along the first hopper 66 and out of the opening 78 when the auger is rotated. The auger 80 can be powered by a motor 86 that is mounted to the frame 67 directly adjacent to the first hopper 66 next to the third wall 72*c*. In one preferred embodiment of the present invention, the motor 86 is the ¼ horsepower motor, model number B162FT-G2 described above.

Figure 12:
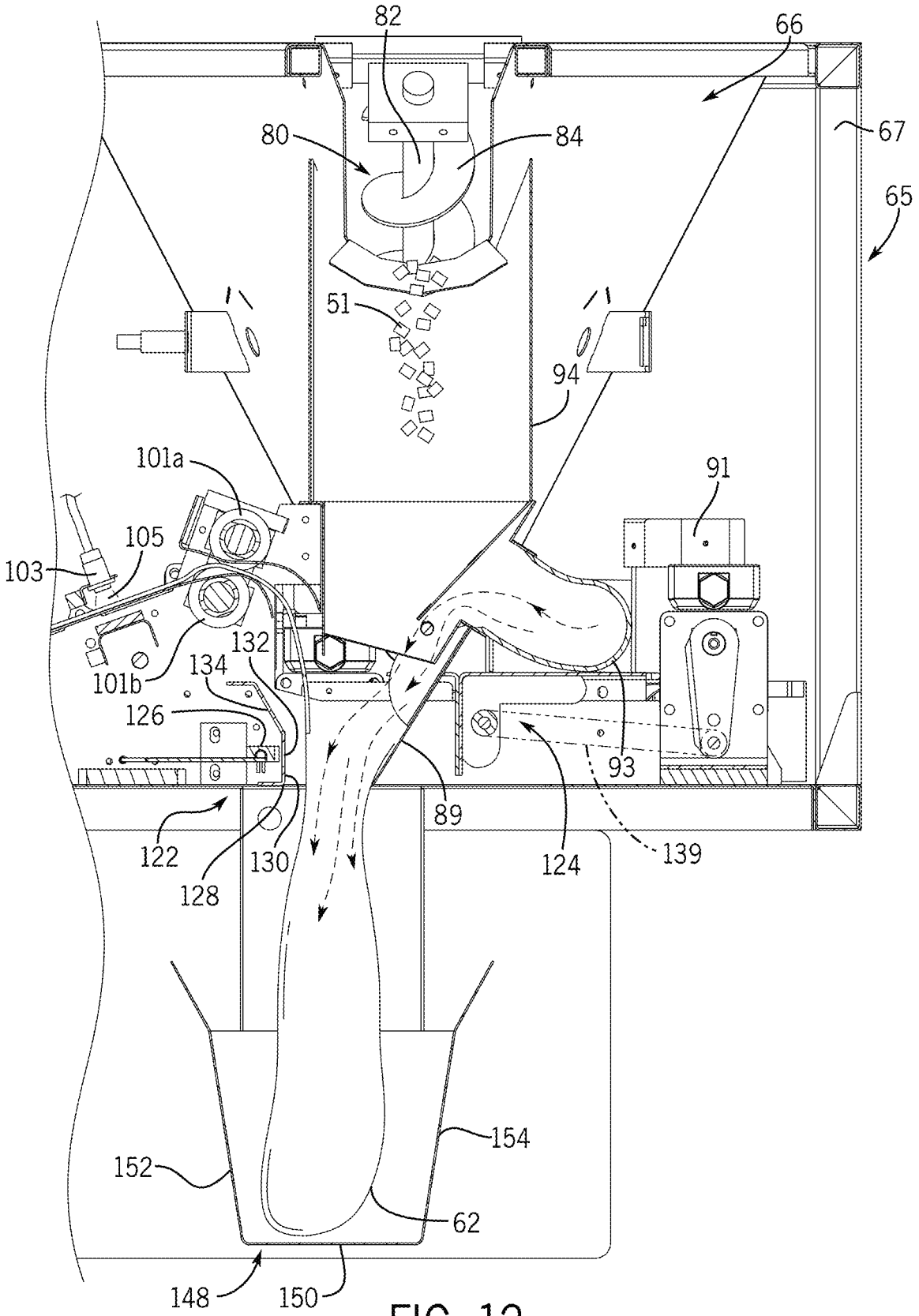
FIG. 12 is a second cutaway side elevation view showing ice being moved through the first hopper into the second hopper and a bag that is opened by a blower.

As shown in FIGS. 2-5 and 11-13, the ice vending machine 50 also has a second hopper 94 into which ice is deposited from the first hopper 66. The second hopper 94 has four sides 96*a*, 96*b*, 96*c*, 96*d* with a funnel 88 at the bottom which is sloped towards an opening 90 through which the ice is funneled to a chute 89 into a bag 62 using a bagging system 98 that will be further described below. As such, the second hopper 94 serves as a chute that guides ice through the opening 90 into a bag 62. Additionally, the second hopper 94 may also include a blower opening 92 formed in the funnel 88 directly adjacent to the opening 90. The blower opening 92 is configured to blow air through the opening 90 in order to open a bag 62 in order to prepare the bag 62 for delivery of ice 51 as seen in FIG. 12. In such an embodiment a blower motor 91 is connected to the blower opening 92 by a hose 93.

While many of the components associated with the bagging system 98 are showed in U.S. application Ser. No. 16/432,531, which is incorporated herein by reference, some components are different and/or improved as will further be described below. The bagging system 98 includes a bagging motor 100 that rotates first and second bag rollers 101*a*, 102*b* to move a bag 62 into position prior to the filling of the bag 62 with ice, as well as a sensor 103. The bagging motor 100 is configured to move a bag or bags 62 quickly off of a roll 102 of bags to ensure high-speed filling of the bags 62 of ice. The sensor 103 is preferably configured to read a printed message, logo, bar code, etc. that is printed on the bag 62 while the bag 62 is moved into position about a viewing area 105 of the sensor 103. An encoder is preferably connected to the sensor 103 that ensures that the bags 64 are from an authorized provider. In a preferred embodiment, the roll of bags 102 is rotated a specified amount depending on whether the sensor is blocked or unblocked. For instance, the bag feed motor 100 may be a stepper type motor, where the roll 102 of bags is rotated a certain number of "clicks" depending on when the sensor is blocked or unblocked to position a new bag for filling. In the event that the sensor 103 and encoder are unable to verify that the bags 64 are from an authorized provider because the message, logo, bar code, etc. are not correct, the machine 50 can be powered down and an error message can be displayed until a user is able to realign the roll of bags 102 such that the sensor 103 confirms they are from an authorized provider.

Figure 6:
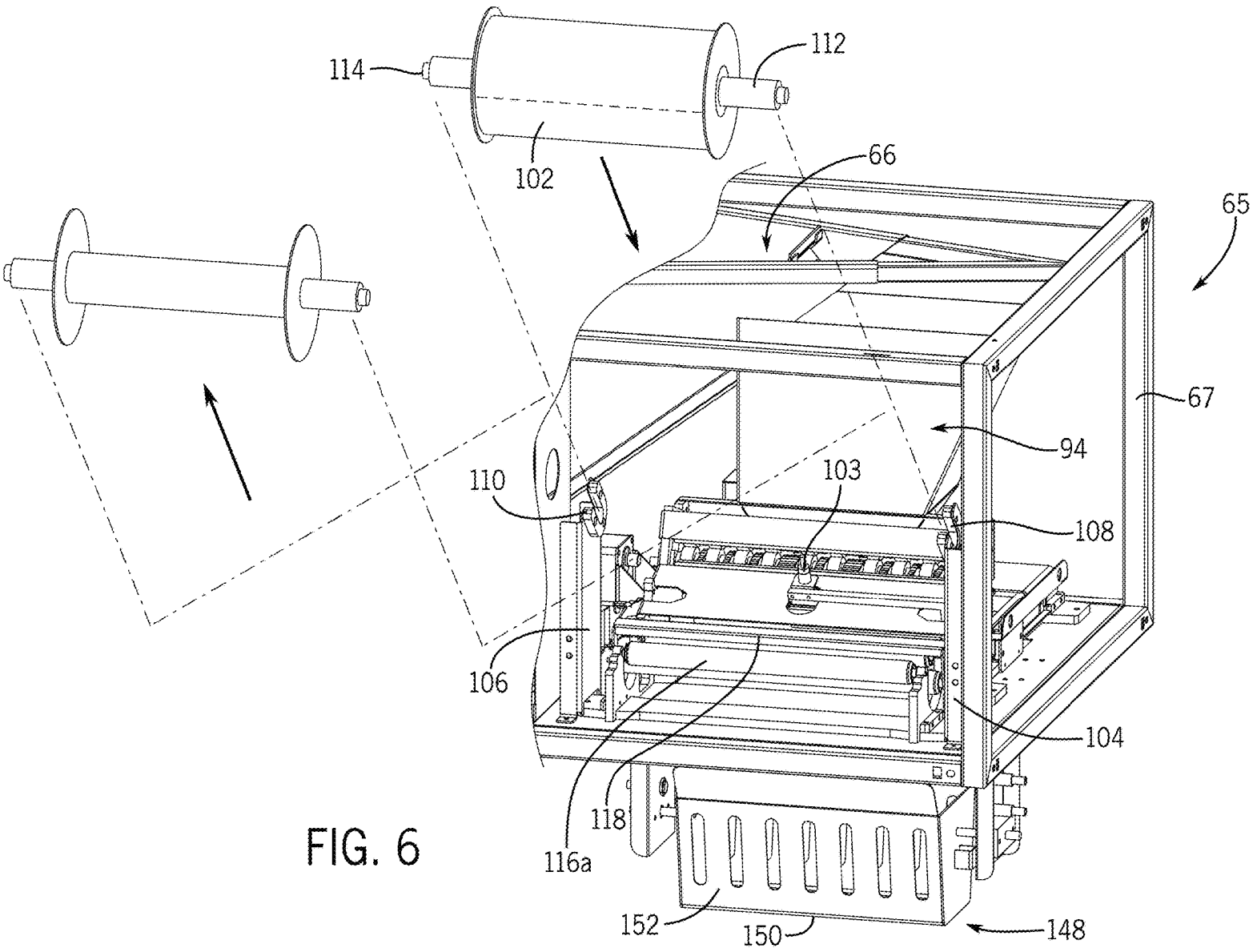
FIG. 6 is a cutaway isometric perspective view of the ice storage and bagging section where a roll of bags is replaced.
Figure 7:
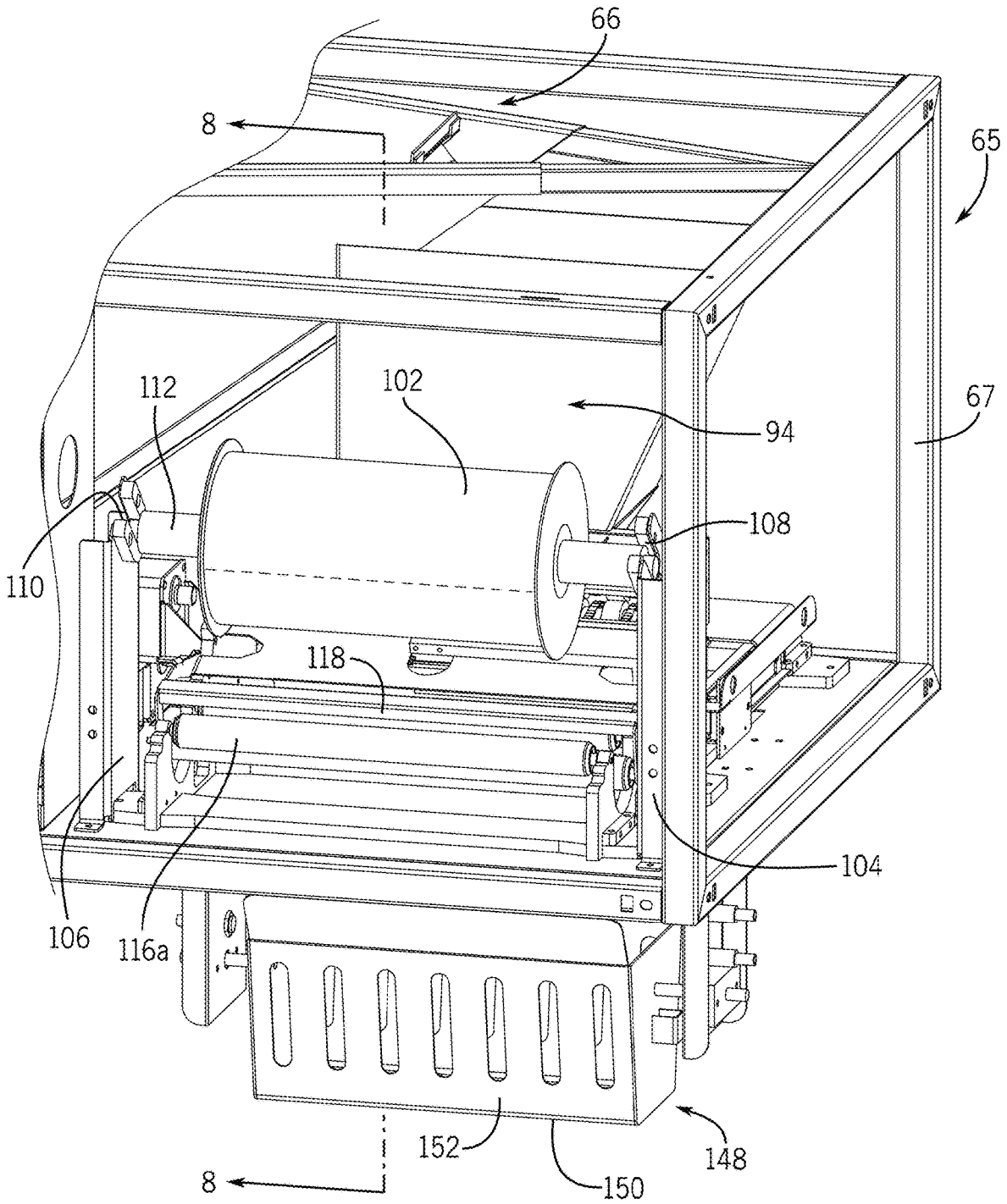
FIG. 7 is a cutaway isometric perspective view of the ice storage and bagging section once the new roll of bags is installed.
Figure 8:
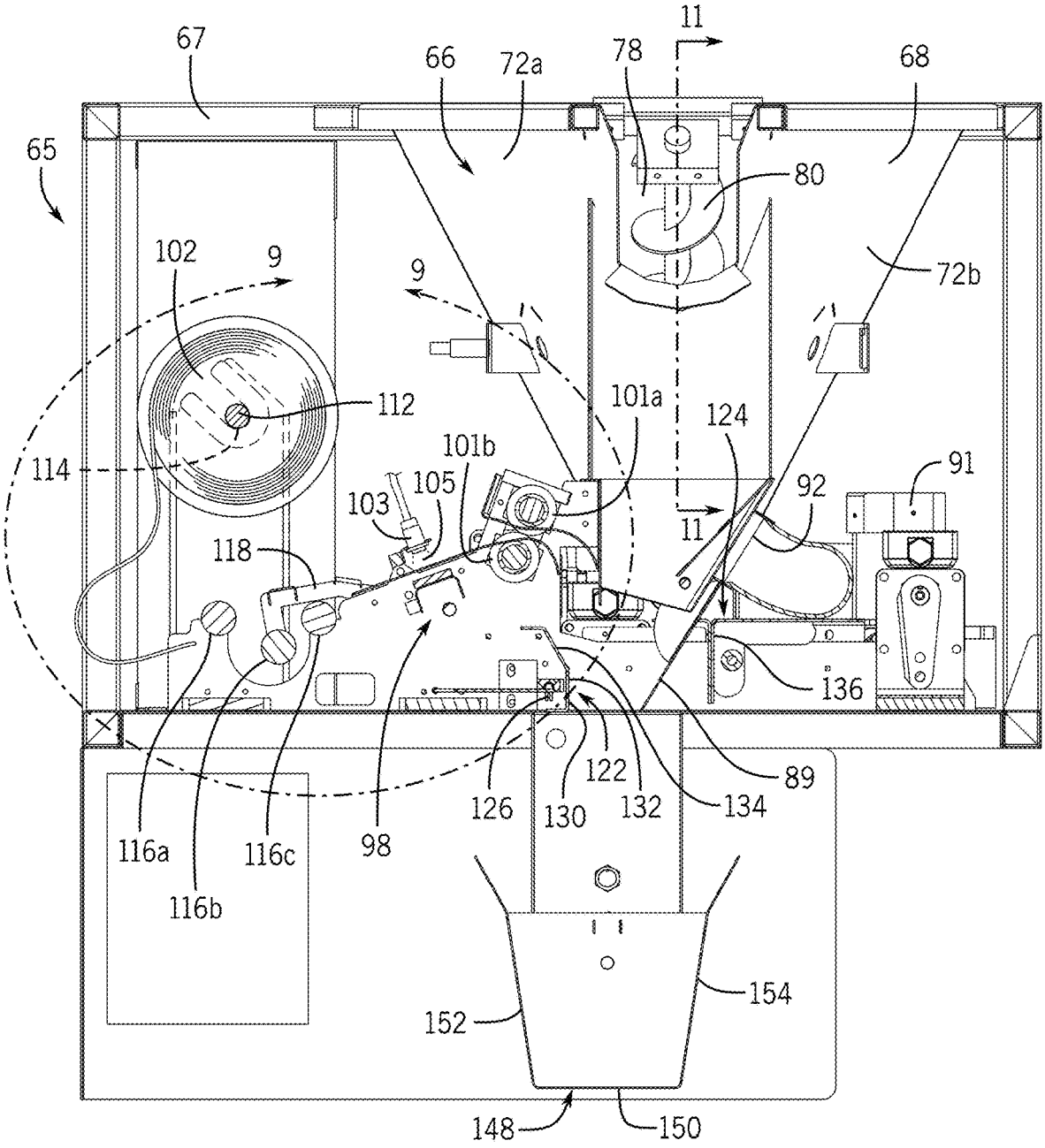
FIG. 8 is a cutaway side elevation view taken about line 8-8 of FIG. 7.
Figure 9:
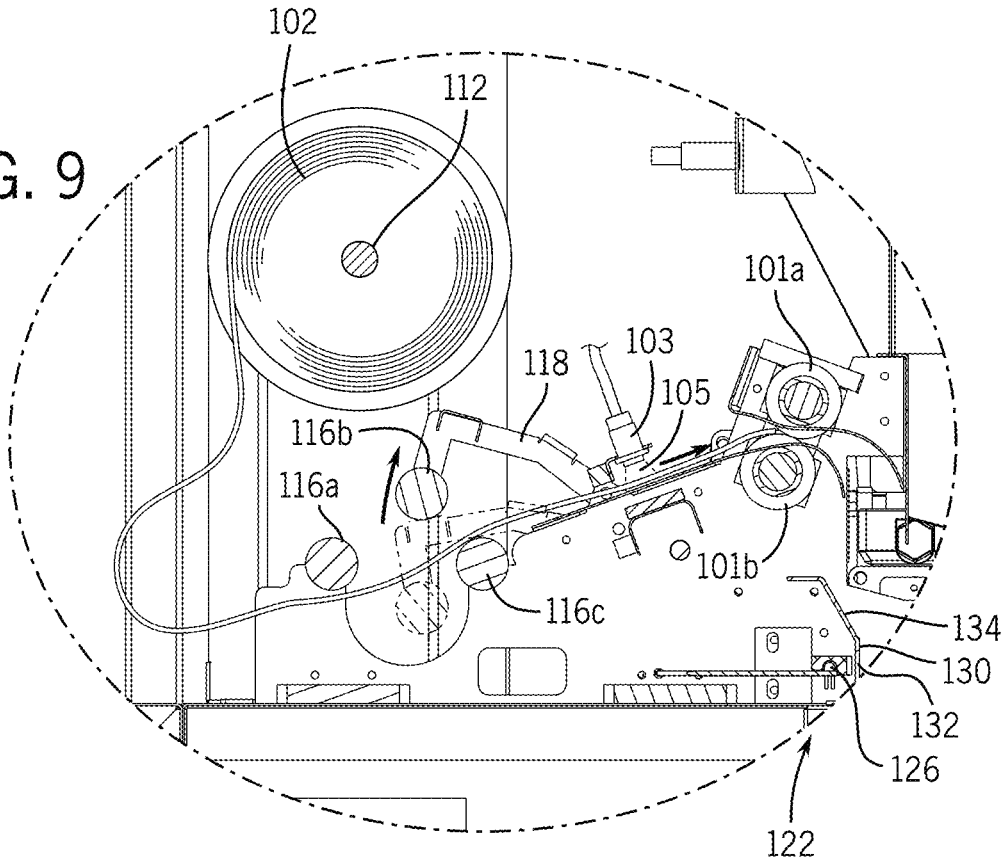
FIG. 9 is a detailed cutaway side elevation view taken about line 9-9 of FIG. 8 where the roll of bags is threaded through the machine.
Figure 10:
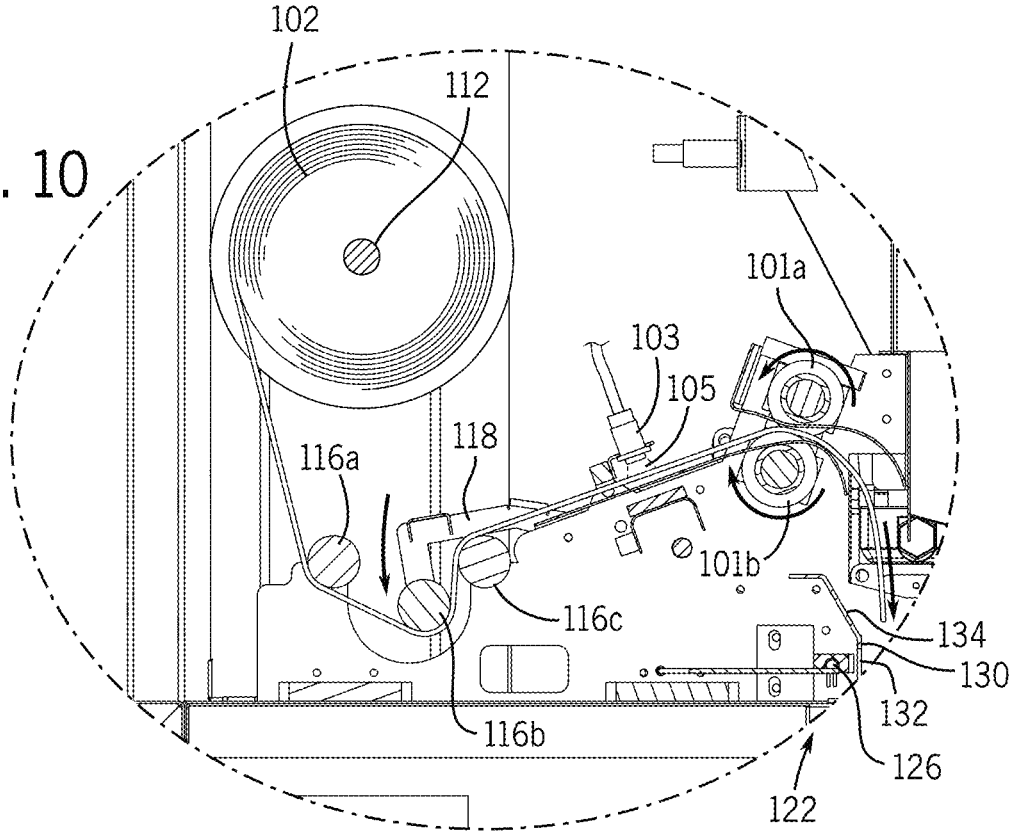
FIG. 10 is a detailed cutaway side elevation of FIG. 9 once a tension arm is pivoted to secure the roll of bags in place and once a pair of bag rollers advance the roll of bags about the machine.

As best shown in FIGS. 6 and 7, the roll of bags 102 are held in place by first and second arms 104, 106. The first and second arms 104, 106 are mounted within the cabinet 52 to the frame 67. Each of the arms 104, 106 have a slot 108, 110 formed therein. The slots 108, 110 are located at the top of the arms 104, 106 and face an exterior of the cabinet 52 so as to enable quick and easy installation of a fresh roll of bags 102 once the front maintenance panel 58 is removed. To install a fresh roll of bags 102, opposite ends 114 of a rod 112 extending through the roll of bags 102 are engaged into the slots 108, 110. The roll of bags 102 is then routed around through multiple guider rolls 116 as can be seen in FIGS. 9 and 10. For instance, as shown the roll of bags 102 are routed under first and second guider rolls 116 *a*, 116 *b*, and then over a third guider roll 116 *c* before being secured between the bag rollers 101 *a*, 101 *b*. Of course, additional or fewer guider rolls could be included to ensure smooth and efficient deliver of the bags from the roll of bags 102 to the bagging system 98. Additionally, the illustrated embodiment includes a tension arm 118 configured to be lifted when a fresh roll of bags 102 are installed, and the biased downwardly directly adjacent one or more of the guider rolls 116 once the roll of bags 102 have successfully been installed and engaged with the bag rollers 101, such that the bags 102 are secured between the guider rolls 116 and the tension arm 118. As shown, the second roller 116 *b* is affixed to the tension arm 118. The roll of bags 102 are advanced through the system using the bag rollers 101 as shown in FIG. 10.

Figure 15:
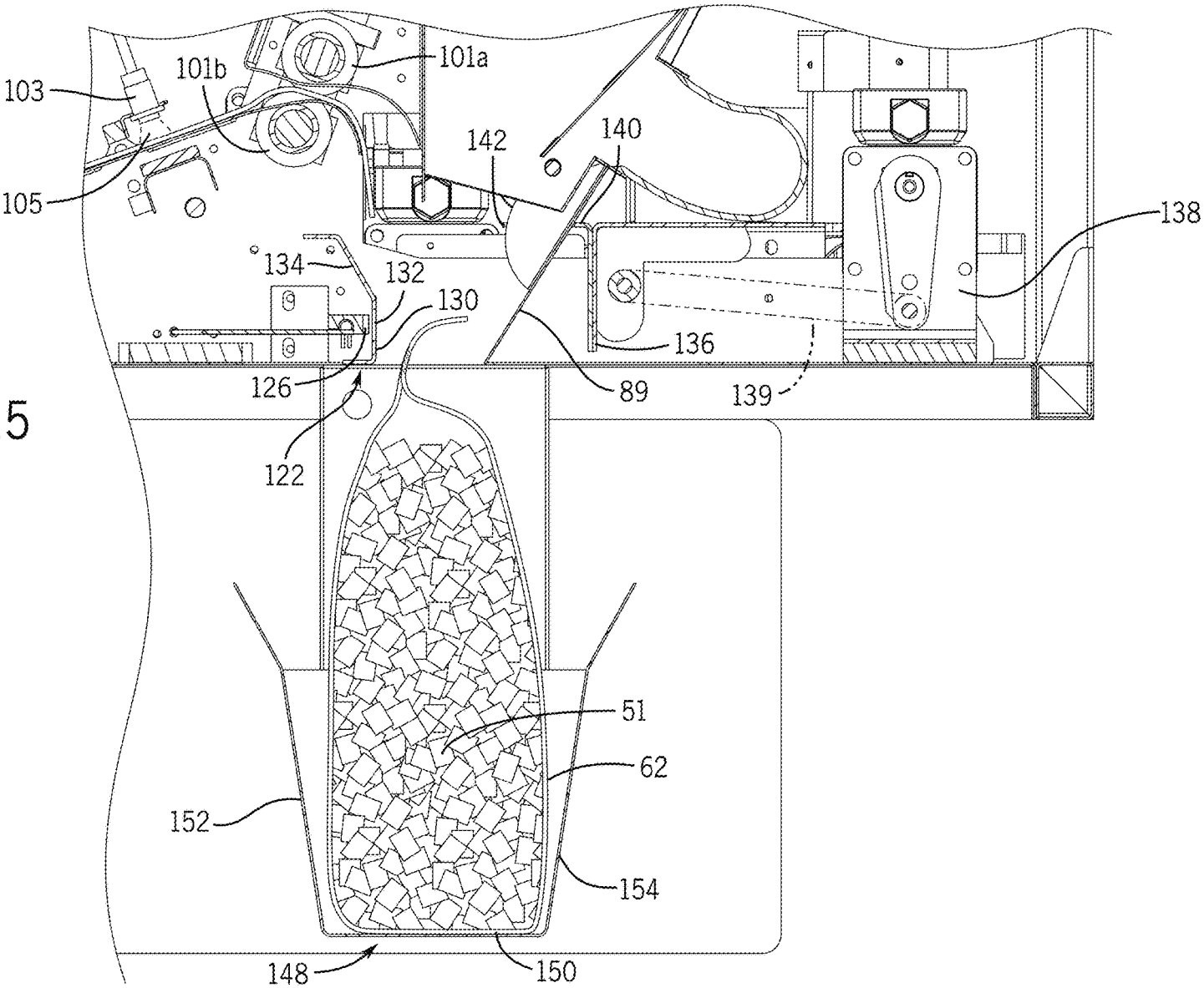
FIG. 15 is a detailed cutaway side elevation view showing the bag being detached from the roll once it is sealed.
Figure 16:
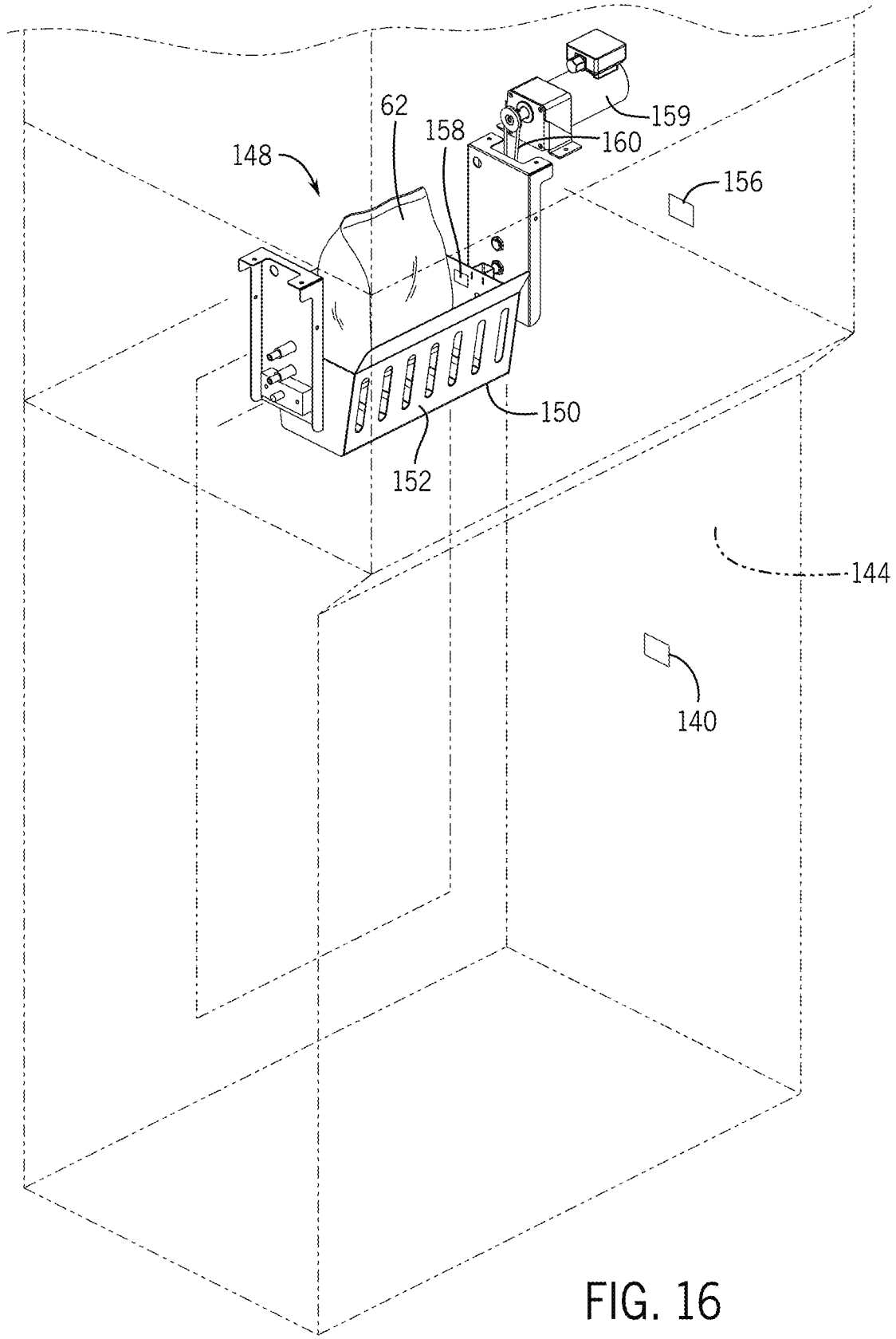
FIG. 16 is an isometric perspective view of a cradle holding the sealed bag of ice of FIG. 15.

Once the bag has been filled by the bagging system 98, the bag 62 is sealed using a sealing system 120. The sealing system 120 may be similar to that shown and described in U.S. application Ser. No. 16/432,531, although some components are different and/or improved as described below. In the illustrated embodiment, the sealing system 120 includes a heating section 122 and a chute pusher section 124, as can best be seen in FIG. 14. The heating section 122 includes a heating element 126 that is heated to a desired temperature in order to seal the bag 62. The heating element 126 is surrounded and protected by a pusher plate 128. The illustrated pusher plate 128 includes a vertical portion 130, an opening 132 in the vertical portion 130, and an angled portion 134. When the bag 62 is ready to be sealed, the pusher plate 128 is moved away from the chute pusher section 124 so that vertical portion is moved away from the chute pusher section 124 while the heating element 126 remains in the same location, best seen in FIG. 14. As a result of this movement of the pusher plate 128, the heating element 126 moves through the opening 132 such that it is exposed. When this occurs, the bag 62 contacts the heating element 126 and is sealed by the heating element 126. For instance, the bag 62 may contact the heater element 126 for approximately 1-6 seconds, and more preferably approximately 3 seconds to ensure proper formation of the bag 62. Once the bag 62 is sealed, the pusher plate 128 may be returned to its initial position, such that again the vertical portion 130 surrounds and protects the heating element 126, as best seen in FIG. 15. The pusher plate 128 may be spring loaded in order for it to appropriately bias between the positions described above, although any other biasing mechanism could be used to achieve the same result.

In addition to the heating section 122, the chute pusher section 124 is also configured to help bias the bag 62 appropriately to ensure proper sealing of the bag. More specifically, the chute pusher section 124 includes components that enable movement of the chute 89 relative to the heating section. More specifically, the chute pusher section 124 includes a vertical portion 136 that is located directly adjacent to the chute 89. When the bag 62 is being sealed, a motor 138 connected to the vertical portion 136 by an arm 139 is activated to enable movement of the vertical portion 136. The vertical portion 136 presses against the chute 89 to move the chute 89, and the bag 62 resting upon the chute 89, towards the heating section 122. This further ensures the appropriate amount of contact between the bag 62 and the heating element 126 when the bag 62 is being sealed. The chute pusher section 124 may also include a horizontal element 140. The horizontal element 140 may include a perforated edge 142 that further assists in the separation of the bag 62 once the bag 62 is sealed. Additionally, to further assist with the separation of the bag 62 once the bag 62 is sealed, the bag rollers 101 may be rotated in the reverse direction once the bag 62 is sealed to break the seal between the formed bag 62 and the remaining roll of bags 102. Once the bag 62 has been sealed, the motor 138 is reactivated in the opposite direction to return the chute pusher section 124 to its original position as shown in FIG. 15.

Next, the retrieval storage section 144 will be further described. More specifically, beneath the second hopper 94, the ice vending machine 50 has a storage section 144 for stacking and storing bags. More specifically, the frame 67 may be mounted to the storage section 144. Since the bags 62 may be stored for extended periods of time, the storage section 144 is insulated and cooled to an appropriate temperature to maintain the ice in solid form. As such, bags 62 of ice may be manufactured until the storage section 144 is partially or substantially filled depending on the settings of the machine 50. Preferably, the interior of the storage section 144 has a fill sensor 146. The ice vending machine 50 continues creating bags 62 of ice until the fill sensor 146 is triggered. In one preferred embodiment of the present invention, the fill sensor 146 is in the upper 25% of the storage section 144. Once the fill sensor 146 has been blocked, the manufacture of ice and filling of bags 62 can be stopped. Once enough bags 62 of ice have been removed from the storage section 144, the fill sensor 146 will no longer be triggered, in which case the production of bags 62 of ice will resume until the fill sensor 146 is again triggered, at which point manufacture is again suspended.

Figure 13:
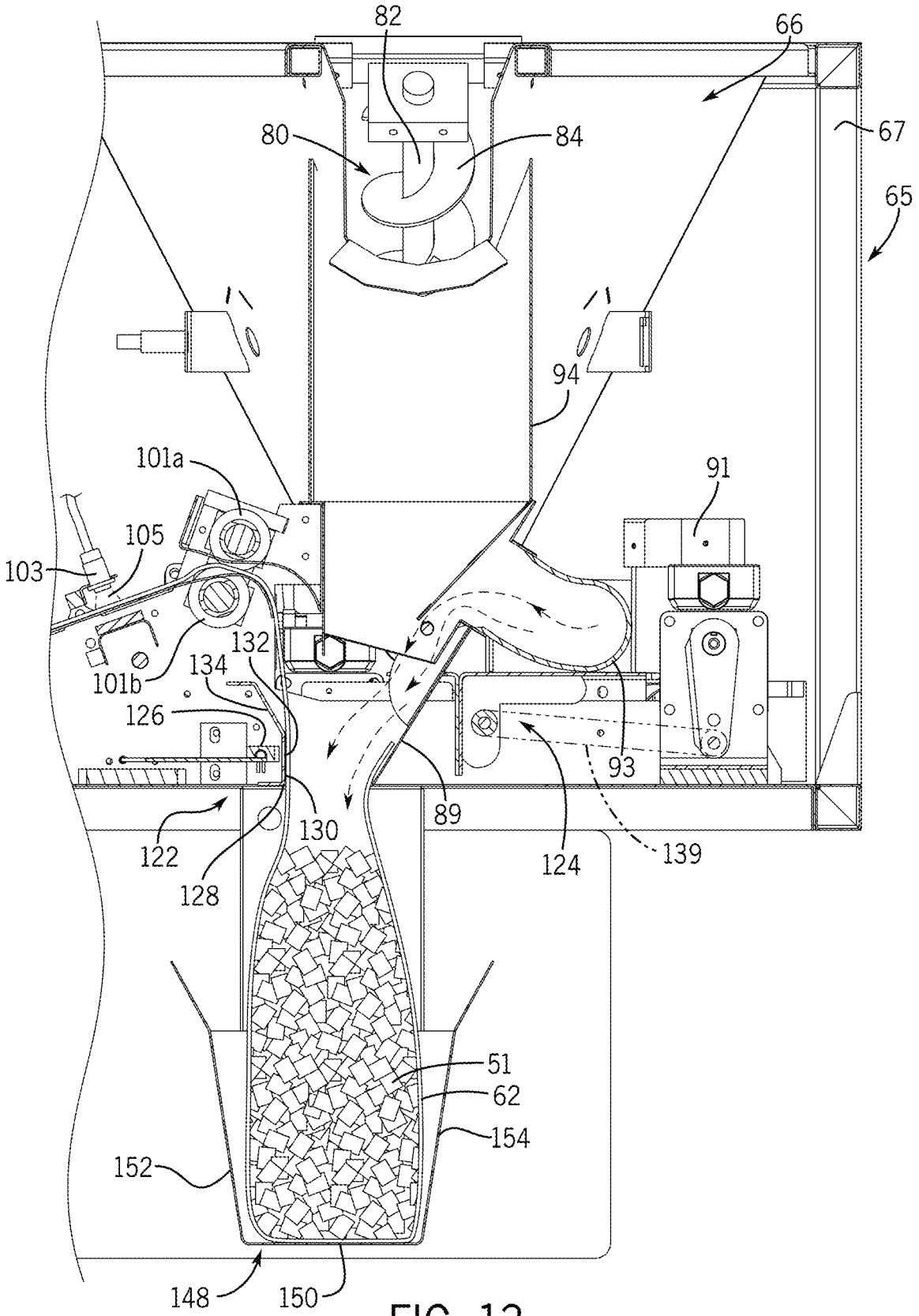
FIG. 13 is another cutaway side elevation view showing the ice being funneled into the bag.
Figure 14:
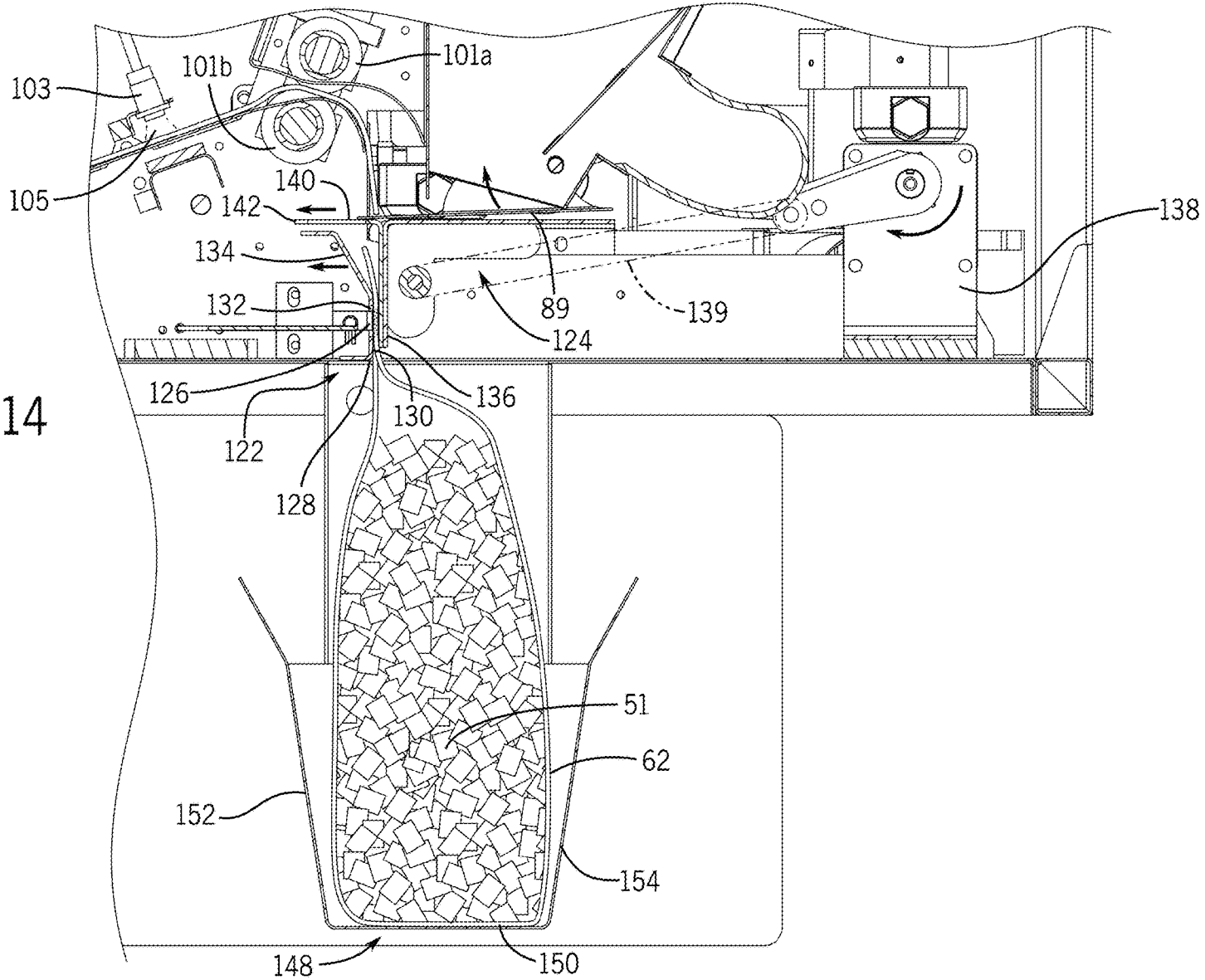
FIG. 14 is a detailed cutaway side elevation view showing the bag being sealed by a sealing system.

Additionally, the ice vending machine 50 has a cradle 148 which supports the bags 62 as they are filled with ice, and then deposits the filled bag into the storage section 144. Preferably, as shown in FIGS. 13-17, the cradle 148 has a bottom 150, and front and back sides 152, 154 to hold the bag 62 in place. In a preferred embodiment, a cradle fill sensor 156 is located adjacent to the cradle 148 to monitor when the cradle 148 is in a position to receive a bag 62 and fill it with ice. An unfilled bag 62 extends into the cradle 148. The bag 62 is then opened preferably using a blower motor 91 with air that is transported by the hose 93 to the blower opening 92 to allow ice to enter into the mouth of the bag 62. See FIG. 13. While the bag 62 remains in the cradle 148, ice is moved from the first hopper 66 using the auger 80 to the second hopper 94, after which the ice will fall downwardly into the bag 62 as seen in FIG. 13.

Preferably a bag full sensor 158 is present that monitors the fill level of a bag 62 that is contained within the cradle 148. In one preferred embodiment, the sensor 158 senses when the bag 62 is partially, but not completely full once the sensor 158 is blocked. When the sensor is blocked, the auger 80 continues to rotate by a control panel a specific number of times to ensure the bag 62 is filled to the appropriate level. By way of example, when a 10-pound bag of ice is desired, the bag 62 can be filled until the sensor 158 detects that 8 pounds of ice are in the bag 62. Thereafter, the auger 80 is rotated a predetermined number of additional rotations to deposit two additional pounds of ice to result in the desired 10-pound bag of ice. Such a configuration results in more accurate bag weight regardless of how much ice is contained in the first hopper 66.

Figure 17:
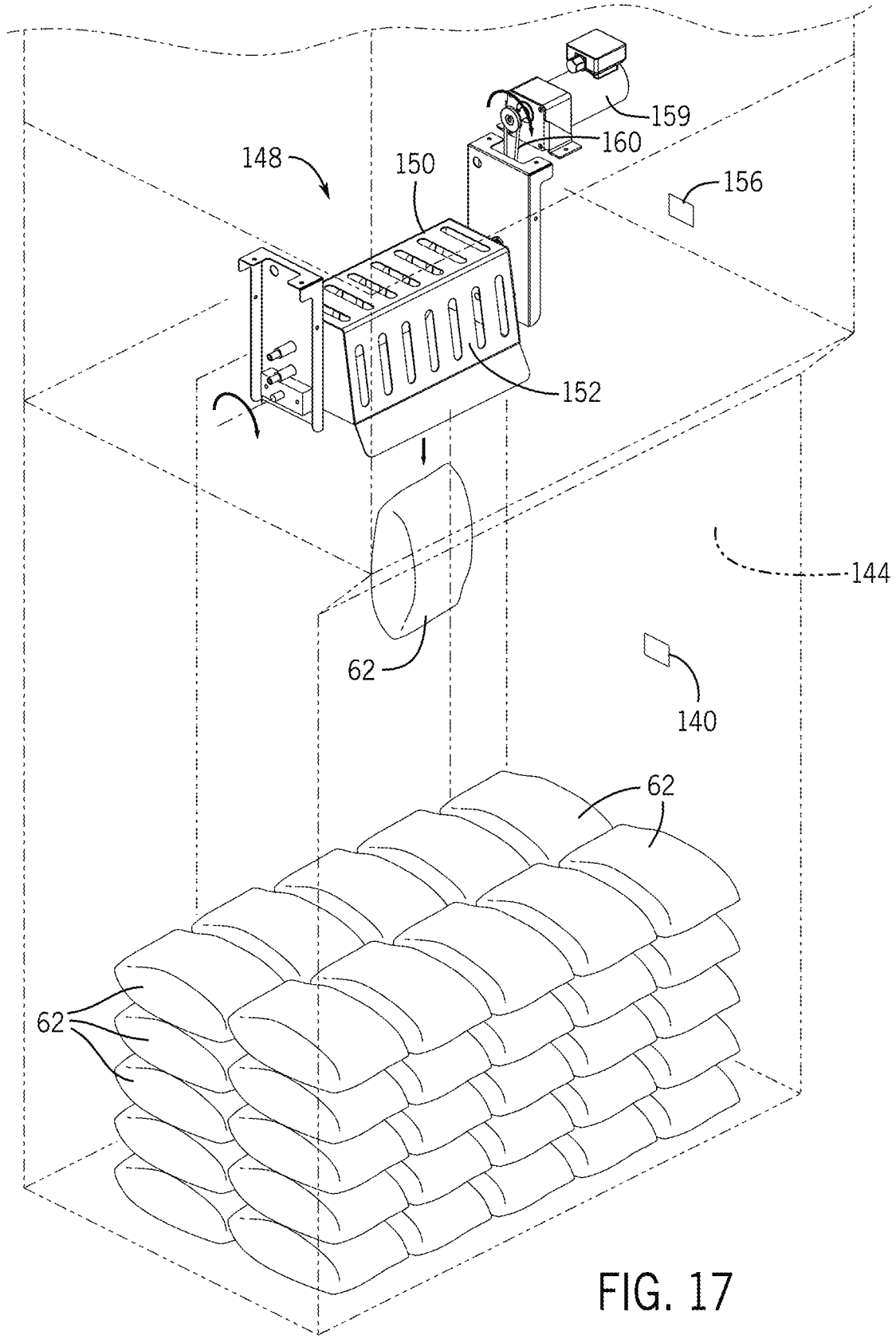
FIG. 17 is an isometric perspective view of the cradle of FIG. 16 rotating to drop the sealed bag of ice into a storage section.

Regardless of when the bag 62 is determined to be full, it is sealed as described above and then prepared for deposit into the storage section 144. As shown, the cradle 148 is connected to a motor 159 with a drive chain 160. More specifically, the drive chain 160 rotates the cradle 148 in a first direction until the bag 62 slides out of the cradle 148 and into the storage section 144 as shown in FIG. 17. Once the bag 62 has been deposited into the storage section 144, the motor drives the drive chain 160 in the opposite direction to return the cradle 148 to the original position so that additional bags 62 can be produced. As described above, bags 62 are continually made until the fill sensor 146 has been blocked.

As shown in the figures and described above, the ice vending machine 50 has a compact size compared to traditional ice vending machines that required a large footprint. More specifically, the ice vending machine 50 has exterior dimensions of approximately 48 inches wide by 32 inches deep by 110 inches in height, with the interior dimensions being 44 inches wide by 28 inches deep. Having such a small footprint is beneficial in that the ice vending machine of the present invention can rest on a standard shelf or fit in the space of a standard shelf of a grocery or convenience store. Because the ice vending machine 50 is approximately 48 inches wide, it is as wide as a standard grocery store shelf. The reduced footprint means that there is less space to store ice in a hopper 66. However, the combination of the speed with which the ice maker 64 makes ice and the power of the motors associated with the auger 80 and other components, the ice vending machine 50 is still capable of quickly filling, sealing, and delivering bags of ice as described above and minimal if any ice is stored in hopper 66.

The ice vending machine 50 has been optimized for quickly bagging the ice, while having a relatively small footprint. For instance, in a preferred embodiment, the ice vending machine is equipped to make a 10-pound bag of ice in approximately 15 seconds. In other embodiments, a 10-pound bag of ice is made in less than 15 seconds. In still other embodiments, a 10-pound bag of ice is made in less than 30 seconds.

In the illustrated embodiments, the machine 50 is operated using a user interface 162 mounted to the cabinet 52, such as a touch panel. In alternative embodiments, the machine is configured to communicate electronically with external communication devices such that bags 62 of ice can be ordered remotely, for instance by paying a cashier, ordering a bag on a phone or tablet application, ordering a bag online, or any other way known to those having ordinary skill in the art.

While the storage section 144 is shown to be insulated and refrigerated, other components of the machine could also be insulated and refrigerated if desired.

Additionally, in certain preferred embodiments, the ice vending machine is delivered in multiple sections and later assembled. For instance, the storage section 144, the ice storage/bagging section 65 and associated components including the hoppers 66, 94 and bagging system 98, and the ice makers 64 could be assembled on site. Additionally, as mentioned above, the ice makers 64 may be changed or the number of ice machines increased or decreased depending on the needs of a given location. Further still, various machines 50 and associated components may be in communication with one another. For instance, when one machine 50 is low on ice or out of ice, a notification may be transmitted so that individuals may physically move filled bags 62 of ice from a location having a surplus to the location that has an insufficient number of filled bags 62 of ice. The machines 50 and associated systems may be configured to allow for and track this borrowing of bags from one to another. Live, online data may be used to monitor such activities and ensure sufficient supply to all machines 50. Further still, live, online data may be used for other purposes, including to plan for preventative maintenance, track operation and breakdown of different components, identify machines that need to be replaced or exchanged with larger or smaller ice makers, and the like in order to optimize operation of machines 50 in general and at specific locations.

It should be understood that the above description, while indicating representative embodiments of the present invention, is given by way of illustration and not of limitation. Many changes and modifications may be made within the scope of the present invention without departing from the spirit thereof, and the invention includes all such modifications.

Various additions, modifications, and rearrangements are contemplated as being within the scope of the following claims, which particularly point out and distinctly claim the subject matter regarding as the invention, and it is intended that the following claims cover all such additions, modifications, and rearrangements.

What is claimed is:

1. An ice machine comprising:

a frame;

a cabinet extending around the frame;

at least one ice maker coupled to the frame;

a first ice hopper located beneath the ice maker and configured to receive ice from the ice maker;

an auger extending along a portion of the first ice hopper to move ice to an opening;

a second hopper configured to receive ice from the first ice hopper moved through the opening by the auger;

a bagging system configured to receive ice from the second hopper;

a cradle configured to support and constrain a bag from the bagging system, while the bag receives ice from the second hopper;

a retrieval section configured to receive the bag after the bag is filled with ice;

a sealing system comprising:

a heating element;

a pusher plate having an opening formed therein;

a biasing assembly coupled to the pusher plate;

wherein the pusher plate is moved by the biasing assembly to expose the heating element for sealing a bag of ice;

a chute extending from and pivotable about the second hopper; and a pusher section configured to bias the bag of ice towards the sealing system to seal the bag of ice using the heating element;

wherein the pusher section is configured to push against and pivot the chute about the second hopper.

2. The ice machine of claim 1, wherein the cabinet is not more than 34 inches in depth.

3. The ice machine of claim 1, further comprising an auger motor configured to have a rotational speed of approximately 1500 rotations per minute; and a gear head that reduces the rotational speed to approximately 115 rotations per minute.

4. The ice machine of claim 3, wherein the first hopper is configured to receive and hold between 50-80 pounds of ice.

5. The ice machine of claim 3, wherein the first hopper is configured to receive and hold between 300-400 pounds of ice.

6. The ice machine of claim 1, further comprising:

a roll of bags removably mounted to the frame;

a motor configured to advance a portion of the roll of bags to the bagging system; and a sensor configured to scan each bag from the roll of bags;

wherein advancement of the roll of bags to the bagging system by the motor is terminated when the sensor detects an unverified bag design.

7. The ice machine of claim 1, further comprising a refrigerated storage section located beneath the bagging system.

8. The ice machine of claim 7, wherein ice is deposited from the second hopper into the bag contained within the cradle; and wherein the cradle is rotated to deposit bags of ice into the refrigerated storage section.

9. The ice machine of claim 1, wherein the first hopper is a drying hopper having a sloped bottom surface to drain water away from the second hopper.

10. A method of using an ice machine comprising:

dropping a plurality of pieces of ice from an ice maker into a first hopper;

opening a bag using a bagging system and supporting and constraining the bag on a cradle;

rotating an auger contained within the first hopper to move ice towards an opening in the first hopper;

dropping ice through the opening into a second hopper;

dropping the ice through the second hopper into the bag;

deactivating the auger;

sealing the bag, wherein sealing the bag further includes heating a heating element, moving a pusher plate to expose the heating element, contacting the bag with the heating element to seal the bag, and moving the pusher plate to separate the heating element from the bag;

moving a pusher section from an original position to bias the supported bag toward the heating element, wherein the pusher section pushes against and pivots a chute extending from and pivotably coupled to the second hopper;

moving the pusher section to the original position;

disengaging the bag from a roll of bags; and moving the bag to a retrieval section.

11. The method of claim 10, further comprising the step of activating a motor having a rotational speed of approximately 1500 rotations per minute to rotate the auger.

12. The method of claim 10, further comprising the steps of:

rotating the auger contained within the first hopper to move ice upwardly towards the opening in the first hopper between first and second sidewalls;

dropping ice through the opening into a second hopper having a funnel; and guiding the ice towards the bag using a chute.

13. The method of claim 10, further comprising the steps of:

advancing the bag from a roll of bags using a roller;

scanning a portion of the bag using a sensor;

comparing the portion of the bag to a database of acceptable bag images; and deactivating rotation of the roller if the portion of the bag does not match the database of acceptable bag images.

14. The method of claim 10, further comprising the steps of:

rotating the cradle about the retrieval section; and dropping the bag of ice into a refrigerated storage space.

15. An ice machine comprising:

a frame;

a cabinet extending around the frame;

at least one ice maker coupled to the frame;

an ice storage and bagging section mounted to the frame comprising:

a first ice hopper located beneath the ice maker and configured to receive ice from the ice maker;

an auger extending along a portion of the first ice hopper to an opening;

a second hopper configured to receive ice conveyed from the first ice hopper by the auger, the second hopper having a funnel and at least one angled side extending upward from the funnel; and a sealing system comprising:

a heating element;

a pusher plate having an opening formed therein;

a biasing assembly coupled to the pusher plate;

wherein the pusher plate is moved by the biasing assembly to expose the heating element for sealing a bag of ice;

a chute extending from and pivotable about the second hopper; and a pusher section configured to bias the bag of ice towards the sealing system to seal the bag of ice using the heating element;

wherein the pusher section is configured to push against and pivot the chute about the second hopper;

a storage section located beneath the bagging section.

16. The ice machine of claim 15, further comprising:

a storage section fill sensor;

wherein the bags of ice will be filled and dropped into the storage section until the storage section fill sensor is blocked.

* * * * *